US007832587B2

(12) United States Patent
West

(10) Patent No.: US 7,832,587 B2
(45) Date of Patent: Nov. 16, 2010

(54) BIN HAVING A REVERSIBLE FLAP

(75) Inventor: Gavin Lloyd West, Portslade (GB)

(73) Assignee: Kennedy Hygiene Products, Ltd, East Sussex (GB)

( * ) Notice: Subject to any disclaimer, the term of this patent is extended or adjusted under 35 U.S.C. 154(b) by 810 days.

(21) Appl. No.: 11/596,084

(22) PCT Filed: Nov. 5, 2004

(86) PCT No.: PCT/GB2004/004695

§ 371 (c)(1),
(2), (4) Date: Nov. 9, 2006

(87) PCT Pub. No.: WO2005/108244

PCT Pub. Date: Nov. 17, 2005

(65) Prior Publication Data

US 2008/0029513 A1 Feb. 7, 2008

(30) Foreign Application Priority Data

May 10, 2004 (GB) ..... 0410392.5

(51) Int. Cl.
*B65D 43/26* (2006.01)

(52) U.S. Cl. ..... 220/262; 220/263; 220/264

(58) Field of Classification Search ..... 220/211, 220/26, 263, 264, 908, 908.12, 262, 908.1
See application file for complete search history.

(56) References Cited

U.S. PATENT DOCUMENTS

| | | | | |
|---|---|---|---|---|
| 2,470,271 | A * | 5/1949 | Steinbacher | 248/97 |
| 4,331,074 | A | 5/1982 | Behman | |
| 4,576,310 | A | 3/1986 | Isgar et al. | |
| 4,729,490 | A | 3/1988 | Ziegenbein et al. | |
| 4,974,746 | A | 12/1990 | Dickinson | |
| 5,148,975 | A | 9/1992 | Dickerson et al. | |
| 5,154,345 | A * | 10/1992 | Shillington | 232/44 |
| 5,494,186 | A * | 2/1996 | Marsh | 220/481 |
| 5,881,896 | A * | 3/1999 | Presnell et al. | 220/252 |
| 5,932,982 | A | 8/1999 | Pezzelli, Jr. et al. | |
| 6,024,240 | A | 2/2000 | Howard et al. | |
| 6,120,743 | A * | 9/2000 | Papari | 422/300 |
| 6,206,231 | B1 | 3/2001 | Laughton | |
| 6,719,194 | B2 * | 4/2004 | Richards | 232/43.1 |
| 2002/0092787 | A1 * | 7/2002 | Cheng | 206/459.5 |
| 2003/0201267 | A1 * | 10/2003 | Yang et al. | 220/263 |
| 2003/0205979 | A1 | 11/2003 | Papari et al. | |
| 2004/0004080 | A1 | 1/2004 | Yang et al. | |

FOREIGN PATENT DOCUMENTS

| | | |
|---|---|---|
| FR | 2 701 014 | 8/1994 |
| FR | 2 810 023 | 12/2001 |
| GB | 2 298 126 | 8/1996 |
| WO | WO 90/11951 | 10/1990 |
| WO | WO 03/018441 | 3/2003 |

* cited by examiner

*Primary Examiner*—Anthony Stashick
*Assistant Examiner*—Madison L Wright
(74) *Attorney, Agent, or Firm*—McGuireWoods LLP

(57) ABSTRACT

A pedal bin includes a container, a pedal and a pivotably mounted flap. The flap is locatable in a first position to facilitate opening of the flap in a first direction relative to the container. The flap is also locatable in a second position to facilitate opening of the flap in a second direction relative to the container. In either position, the pedal is operable to open the flap.

19 Claims, 6 Drawing Sheets

BIN HAVING A REVERSIBLE FLAP

CROSS-REFERENCE TO RELATED APPLICATIONS

The present application is a National Stage of International Application No. PCT/GB2004/004695 filed on Nov. 5, 2004 which claims the benefit of British Application No. 0410392.5 filed on May 10, 2004.

BACKGROUND OF THE INVENTION

The present application relates to a bin having a flap which may be reversed. More particularly, the present application relates to a sanitary hygiene bin having a reversible closure flap.

Sanitary hygiene bins for disposing of sanitary products are well known. These bins are typically pedal operated with the pedal being provided on a front of the bin. A pivotally mounted closure flap is generally provided which opens towards the front of the bin when the pedal is operated.

It is also known to provide a pedal bin with a closure flap which opens towards a side of the bin other than the side on which the pedal is provided. This arrangement provides easy access to the interior of the bin from the side to which the flap opens. However, the inventors in the present case have appreciated that it is undesirable to produce bins which must be handed (i.e. which open to the left or right hand side of the bin whilst allowing the pedal to remain facing forwards) to suit particular applications.

SUMMARY OF THE INVENTION

Viewed from a first aspect, the present invention relates to a pedal bin comprising a container, a pedal and a pivotally mounted flap; the flap being locatable in a first position to facilitate opening in a first direction relative to the container, and the flap also being locatable in a second position to facilitate opening thereof in a second direction relative to the container; wherein the pedal is operable to open said flap when the flap is located in said first and second positions.

This arrangement is particularly desirable as it allows the orientation of the flap to be reversed. Thus, left and right handed versions of the bin may be produced simply by locating the flap in either the first or second positions. Therefore, the flap may open to the left or right hand side of the bin with the pedal facing forwards for ease of use. The pedal preferably operates the flap when it is either in said first or second positions without modifying the pedal or any actuating mechanism provided in the bin.

The first and second directions in which the flap opens are preferably opposite to each other. However, it will be appreciated that in certain applications it may be desirable if the first and second directions are, for example, orthogonal to each other. Indeed, it may be desirable to adapt the bin to allow the flap to be located also in a third position, or even a fourth position, to allow the flap to open towards the side of the bin in which the pedal is provided or to one or more other sides of the bin.

Preferably, the first direction is to a first side of the bin and the second direction is to a second side of the bin. The first and second sides of the bin are preferably on opposite sides of the bin. The pedal may be provided on a third side of the bin, for example between the first and second sides.

The pedal is preferably coupled to a mechanism for displacing the flap to an open position. The pedal may, for example, be pivotally mounted and a mechanism provided such that displacement of the pedal in a downwards direction causes the upwards displacement of an actuating member which opens the flap.

The flap preferably pivots about a longitudinal axis and the actuating member preferably engages the centre of the flap in a transverse direction. This arrangement advantageously allows the flap to be located in either the first or second positions and operated by the actuating member without necessitating adjustments to the mechanism for opening the flap. It will, of course, be appreciated that alternative arrangements may be employed for this purpose. The actuating member is most preferably located halfway between the first and second sides of the bin.

The flap is preferably provided with first and second members for cooperating with the actuating member. The first member is preferably cooperable with the actuating member when the flap is located in the first position; and the second member is preferably cooperable with the mechanism when the flap is located in the second position. The first and second members may, for example, be arcuate in profile to facilitate smooth opening of the flap. The first and second members are preferably integrally formed with the flap.

The flap preferably pivots about an axis perpendicular to the axis about which the pedal pivots.

The bin is most preferably a sanitary hygiene bin.

It is desirable, although not essential, to provide the flap with a platform on which articles to be disposed of (such as sanitary products) may be placed when the flap is in an open position. The platform is preferably provided on the underside of the flap and is presented when the flap is displaced to its open position. When the flap is returned to its closed position, the platform pivots to a substantially vertical position and the article to be disposed of falls from the platform into the container below. This arrangement is particularly desirable as the platform may obscure from view the contents of the container when the flap is in its open position. The platform may be defined by a planar member and preferably at least partially closes the opening into the container when the flap is displaced to its open position. Most preferably, the platform is also provided with side walls. The platform is preferably integrally formed with the flap.

Viewed from a further aspect, the present invention relates to a bin comprising a flap, a cover, a container and means for opening said flap; the flap being pivotally mounted on the cover and the means for opening said flap being mounted in said cover; wherein the cover is locatable in a first position to facilitate opening of the flap in a first direction relative to the container, and the cover being locatable in a second position to facilitate opening of the flap in a second direction relative to the container.

Viewed from a still further aspect, the present invention relates to a pivotally mountable closure flap for a bin, the closure flap comprising a member for hiding the interior of the bin from view when the flap is in an open position, the flap and the member each having means for removably mounting a protective element thereon.

Viewed from a further aspect, the present invention relates to a protective element for mounting removably on a closure flap of a bin, the protective element comprising a first member, a second member, a first end-wall and a second end-wall, the first and second members being joined along a common side and being angularly offset relative to each other, the first end-wall being joined to the first and second members at a first end thereof and the second end-wall being joined to the first and second members at a second end thereof.

Viewed from a still further aspect, the present invention relates to a container for a bin, the container having at least one side wall and the top of the container being open, wherein at least one slot suitable for receiving a portion of a bag provided in the container is formed in the top of said at least one side wall. This arrangement is particularly advantageous as it allows refuse bags of a range of sizes to be accommodated in the container. It will be appreciated that the benefits of a container of this type are not limited solely to pedal bins since the container may equally be employed in bins of other types.

The container preferably comprises first and second side walls and at least one slot is preferably formed in each of the side walls. Although the or each slot in the first side wall may be offset with respect to the or each corresponding slot in the second side wall, the or each slot in the first side wall is preferably aligned with the or each corresponding slot in the second side wall.

One, two, three, four or more slots may be formed in the or each side wall.

The slot(s) preferably each extend downwardly from an upper edge of the associated side wall.

The container may further comprise an outwardly projecting flange extending around at least a portion of an upper edge of the container. A portion of the refuse bag or sack may be placed over this flange such that, once a lid or closure portion is provided on top of the container, the refuse bag is retained in position.

The slot(s) are preferably each tapered such that they are at their widest at the top edge of the container.

The present application further relates to a bin comprising a container as described herein. The bin may further comprise a closure flap operable by a pedal.

BRIEF DESCRIPTION OF THE DRAWINGS

A preferred embodiment of the present invention will now be described, by way of example only, with reference to the accompanying drawings in which.

DETAILED DESCRIPTION OF THE INVENTION

Figure 1:
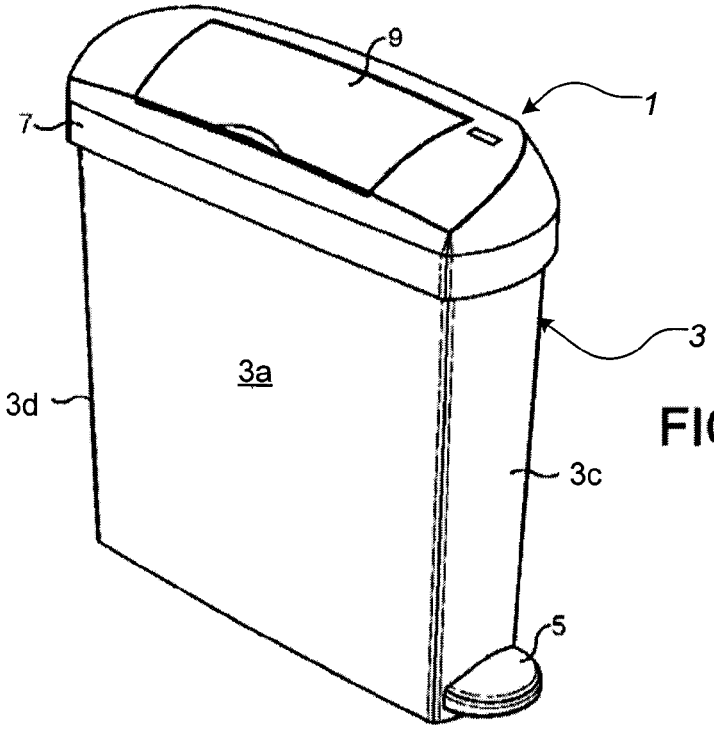
FIG. 1 shows a perspective view of a sanitary hygiene bin in accordance with the present invention with the top cover in a first position.

A sanitary hygiene bin 1 in accordance with the present invention is shown in FIG. 1. The bin 1 is of the pedal bin type and comprises a container 3, a pedal 5, a top cover 7 and a pivotally mounted flap 9 for closing an opening 10 (shown in FIG. 9) in the top cover. The container 3 has front and back walls 3*a*, 3*b*, and first and second side walls 3*c*, 3*d*.

Figure 2:
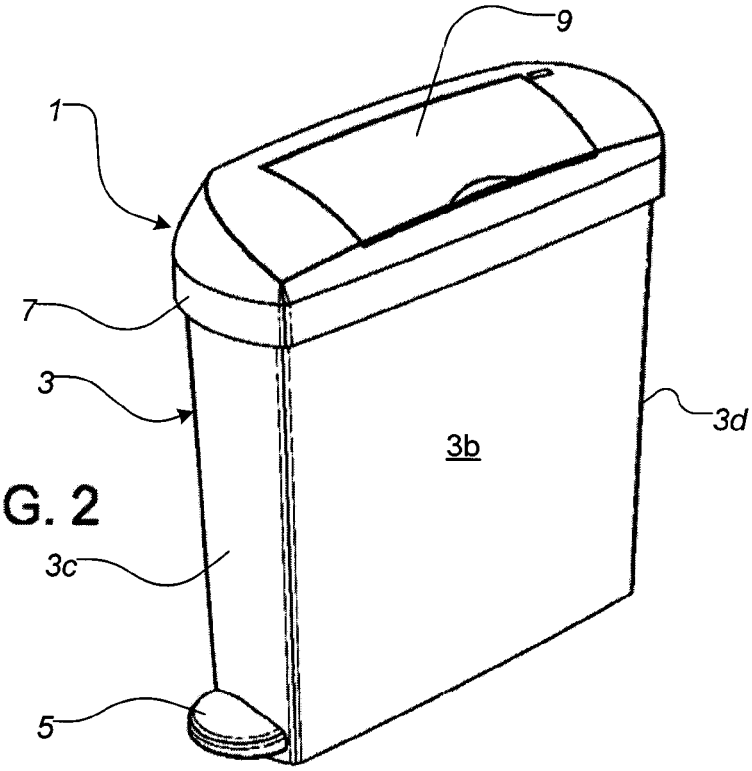
FIG. 2 shows a sanitary hygiene bin in accordance with the present invention with the top cover in a second position.

The horizontal cross-sectional profile of the container 3 and the top cover 7 are symmetrical about first and second orthogonal axes. This symmetry allows the top cover 7 to be located in a first position relative to the container 3, as shown in FIG. 1; and also to be rotated through 180 degrees and located in a second position relative to the container, as shown in FIG. 2. Thus, the top cover 7 is reversible. This reversibility allows the bin to be handed to suit particular applications, for example to be positioned to the left or right hand sides of a toilet. Advantageously, the pedal 5 faces in the same direction in both said left and right handed configurations for ease of operation. For example, the bin may be configured for location to the left or right hand side of a toilet and to open towards the toilet with the pedal facing forwards in both configurations.

With the top cover 7 in the first position, the flap 9 opens towards the front wall 3*a* of the container 3. Conversely, with the top cover 7 in the second position, the flap 9 opens towards the back wall 3*b*.

Figure 3:
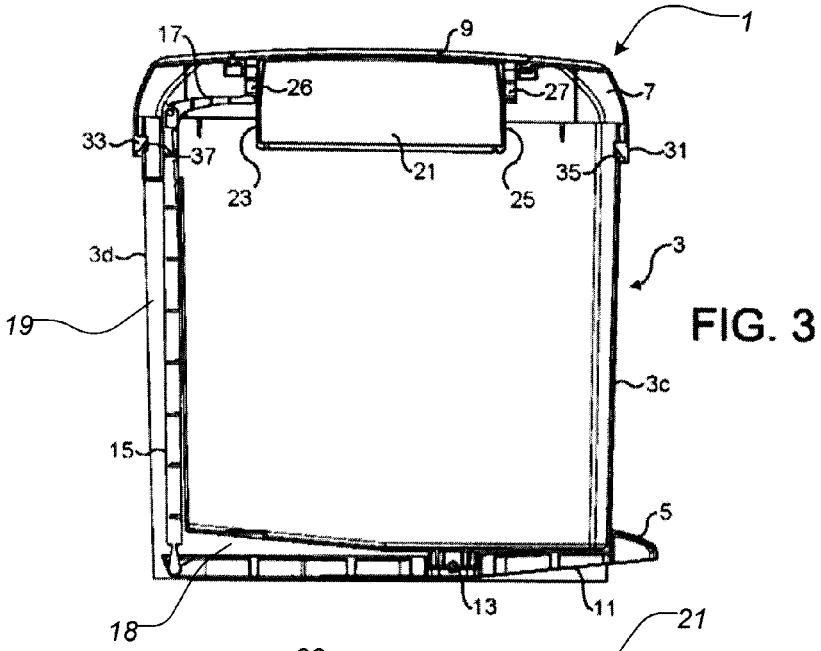
FIG. 3 shows a cross-sectional view of the sanitary hygiene bin shown in FIG. 1 with the flap in a closed position.
Figure 4:
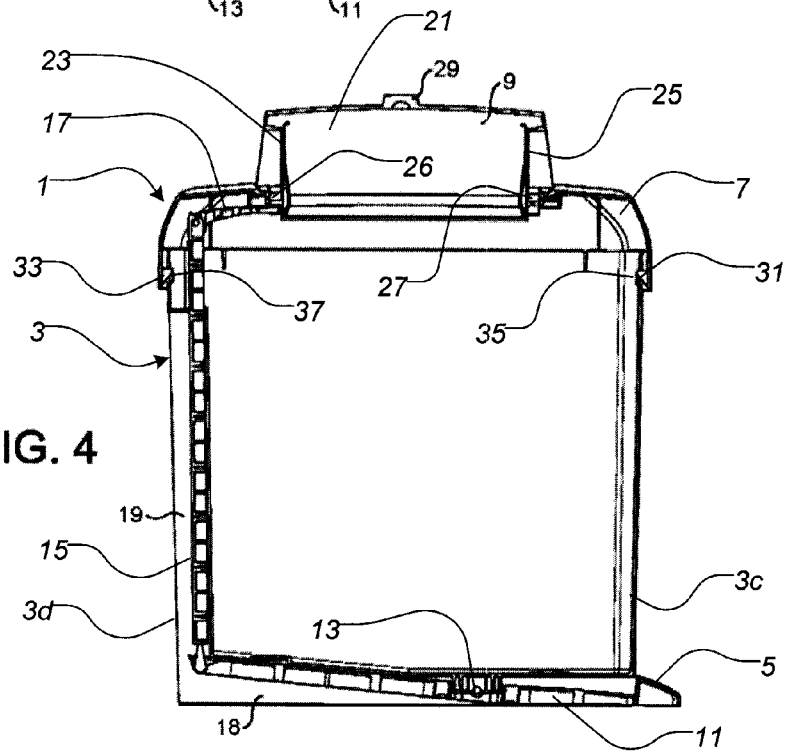
FIG. 4 shows the cross-sectional view of FIG. 3 with the flap in an open position.
Figure 5:
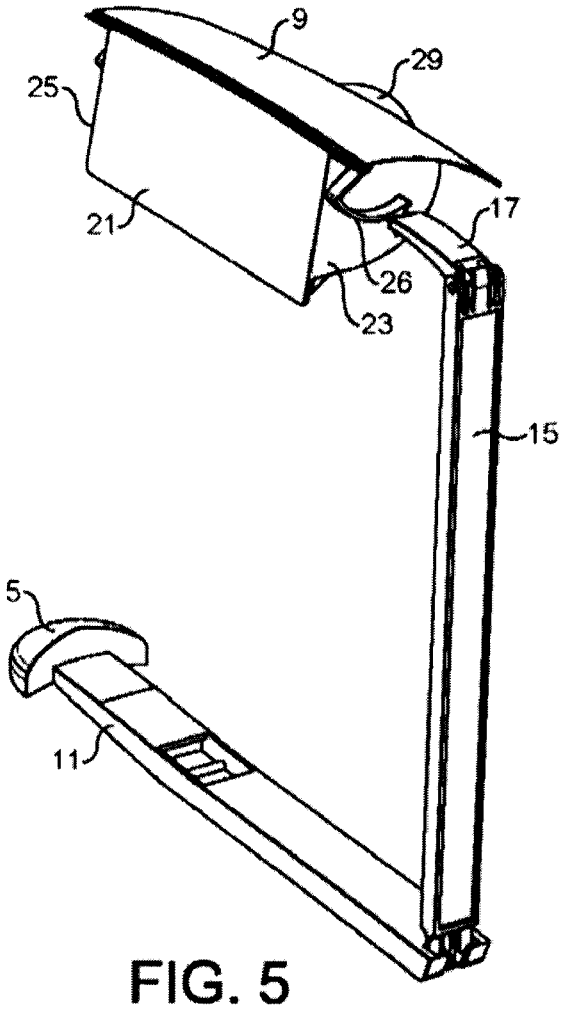
FIG. 5 shows a perspective view of the mechanism for opening the flap of the bin in accordance with the present invention.

As shown in FIGS. 3 and 4, the pedal 5 is integrally formed with a pivot member 11 which pivots about a pivot pin 13. The pedal 5 is provided at the first side wall 3*c* of the bin 1 and extends beyond the front wall 3*a* of the container 3 to allow it readily to be operated. A vertical rod 15 is coupled to the rear of the pivot member 11 and an actuating member 17 is pivotally mounted to the top end of the vertical rod 15. A perspective view of the mechanism for opening the flap 9 is shown in FIG. 5. The pivot member 11 and the vertical rod 15 are received in first and second channels 18, 19 respectively formed in the container 3 as shown in FIGS. 3 and 4.

The pivotal mounting of the actuating member 17 allows it to be pivoted upwards to a first position, substantially co-axial with the vertical rod 15, to facilitate more readily the removal of a full refuse sack from the container 3. The actuating member 17 is preferably biased in a downwards direction towards a second position as shown in FIGS. 3 and 4, ready for use. This pivotal mounting of the actuating member 17 allows the size of the flap 9 to be reduced.

The flap 9 is pivotally mounted in the cover 7 and is movable between an open position and a closed position. The opening 10 in the cover 7 is covered by the flap 9 when it is in its closed position.

The flap 9 further comprises a planar member 21 and first and second end-walls 23, 25. When the flap 9 is in its open position, the planar member 21 forms a shelf on which sanitary products and the like may be placed ready for disposal. Release of the pedal 5 allows the flap 9 to return to its closed position under gravity and any article located on the planar member 21 to be deposited into the container 3.

Advantageously the planar member 21 and the side-walls 23, 25 substantially close the opening 10 in the top cover 7 when the flap 9 is in its open position and thereby hide the interior of the container 3 from view.

The flap 9 is also provided with a first arcuate member 26 and a second arcuate member 27 integrally formed in the first and second end-walls 23, 25. The first arcuate member 26 is arranged to cooperate with the actuating member 17 when the top cover 7 is located in the first position, as best shown in FIG. 5. When the top cover 7 is reversed to the second position, as shown in FIG. 2, the actuating member 17 cooperates with the second arcuate member 27 provided on the flap 9.

The flap 9 is also provided with a finger grip 29, as shown in FIG. 4, to allow the flap 9 to be opened without using the pedal 5.

The top cover 7 is provided with first and second resilient clips 31, 33 which are received in openings 35, 37 provided in the front and back walls 3*a*, 3*b* of the container 3. The resilient clips 31, 33 retain the top cover 7 in position during normal use, but may be released to allow the container 3 to be emptied or to reverse the orientation of the top cover 7.

As illustrated in FIG. 4, downward displacement of the pedal 5 causes the vertical rod 15 and the actuating member 17 to be displaced in an upwards directions. The upwards displacement of the actuating member 17 causes it to engage the first arcuate member 26 and pivot the flap 9 to its open position.

Figure 6:
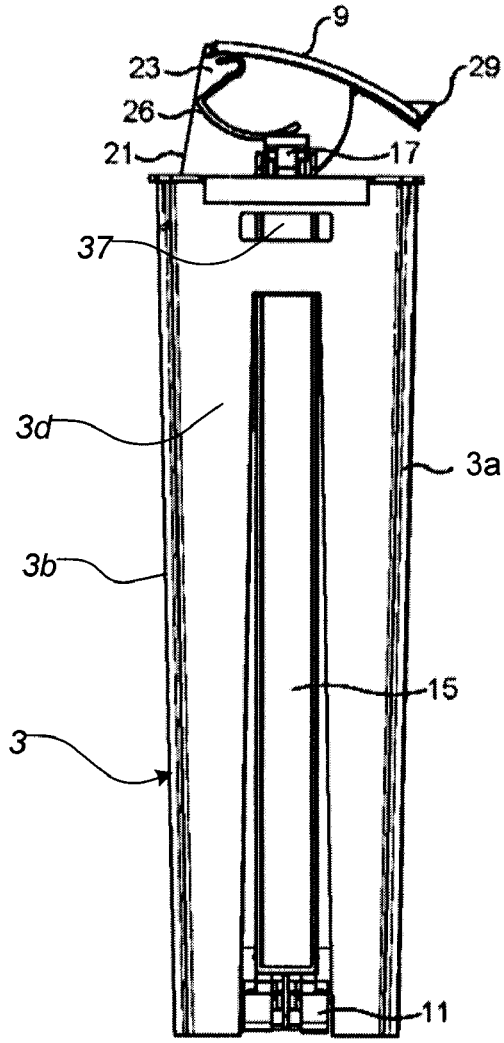
FIG. 6 shows an end view of the bin in accordance with the present invention with the top cover omitted.

As shown in FIG. 6, the actuating member 17 is located half-way between the first and second side walls 3*c*, 3*d* of the bin 3 to ensure uniform opening of the flap 9 irrespective of whether the top cover 7 is in the first or second position.

Figure 7:
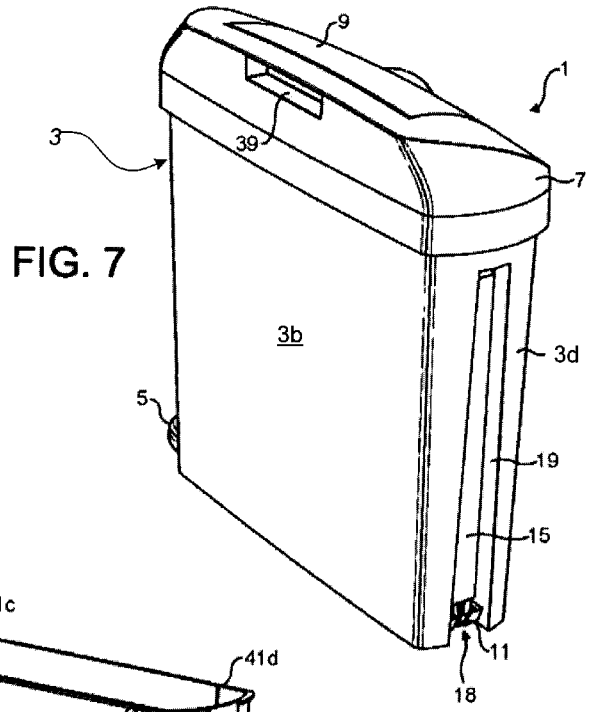
FIG. 7 shows a rear perspective view of the bin in accordance with the present invention.

As shown in FIG. 7, the top cover 7 is provided with a recess 39 to allow the bin more readily to be handled when in its assembled state.

Figure 8:
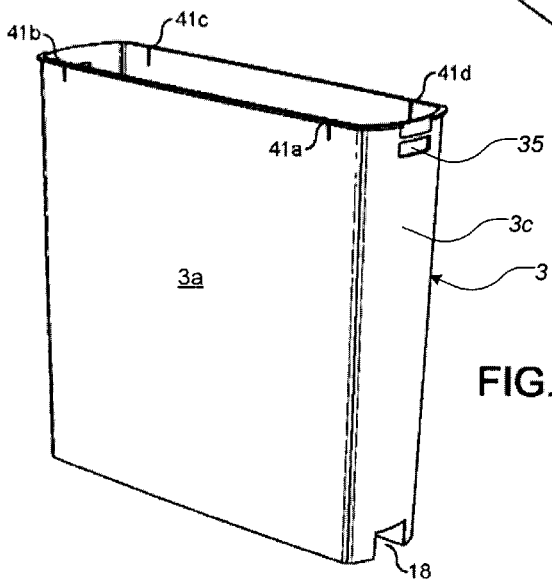
FIG. 8 shows a front perspective view of the container of the bin.

As shown in FIG. 8, the container 3 is provided with a plurality of slots 41*a*, 41*b*, 41*c*, 41*d* in its upper edge for receiving a refuse sack 60 (shown in FIG. 11) and retaining it in position.

Figure 9:
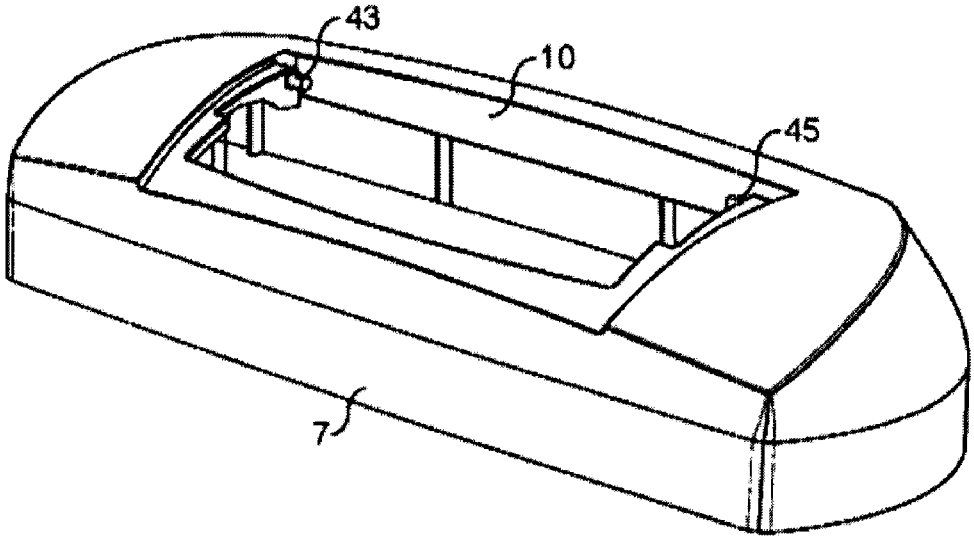
FIG. 9 shows a front perspective view of the top cover of the bin.

A perspective view of the top cover 7 is shown in FIG. 9. First and second projections 43, 45, about which the flap 9 pivots, are provided on opposite sides of the opening 10.

Figure 10:
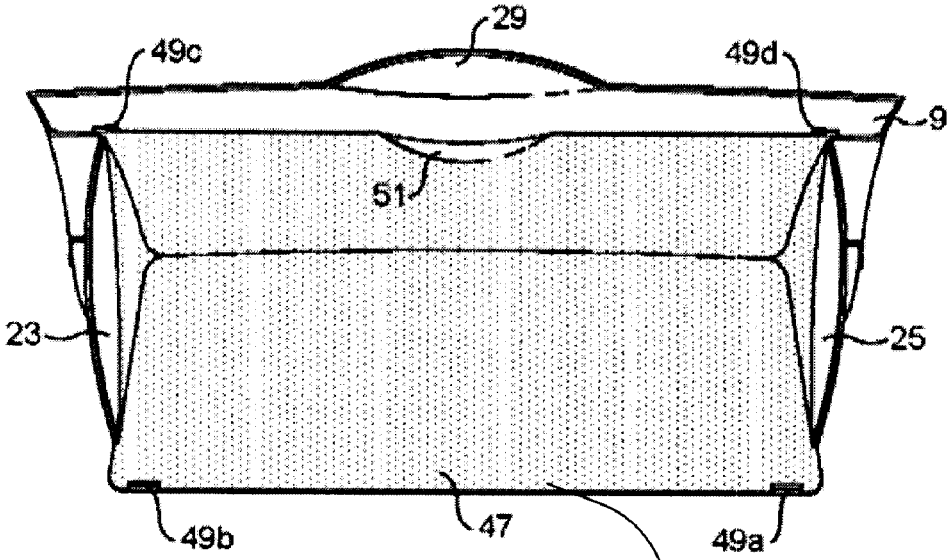
FIG. 10 shows an underside of the flap for closing an opening in the top cover.

As shown in FIG. 10, a protective element 47 is removably mounted on the underside of the flap 9. The protective element 47 partially covers the underside of the flap 9, the planar member 21 and the first and second end-walls 23, 25. The protective element is secured in position by four protrusions 49*a-d* formed on the underside of the flap 9 and on the surface of the planar member 21 exposed when the flap 9 is pivoted to its open position. The protective element 47 is molded from a transparent plastics material and is provided with a grip portion 51 to allow it readily to be removed. The grip portion 51 may be convex-shaped. The protective element 47 may be disposed of when the bin 1 is emptied and thereby may improve sanitary hygiene and protect the flap 9 and planar member 21 from staining during use.

Figure 11:
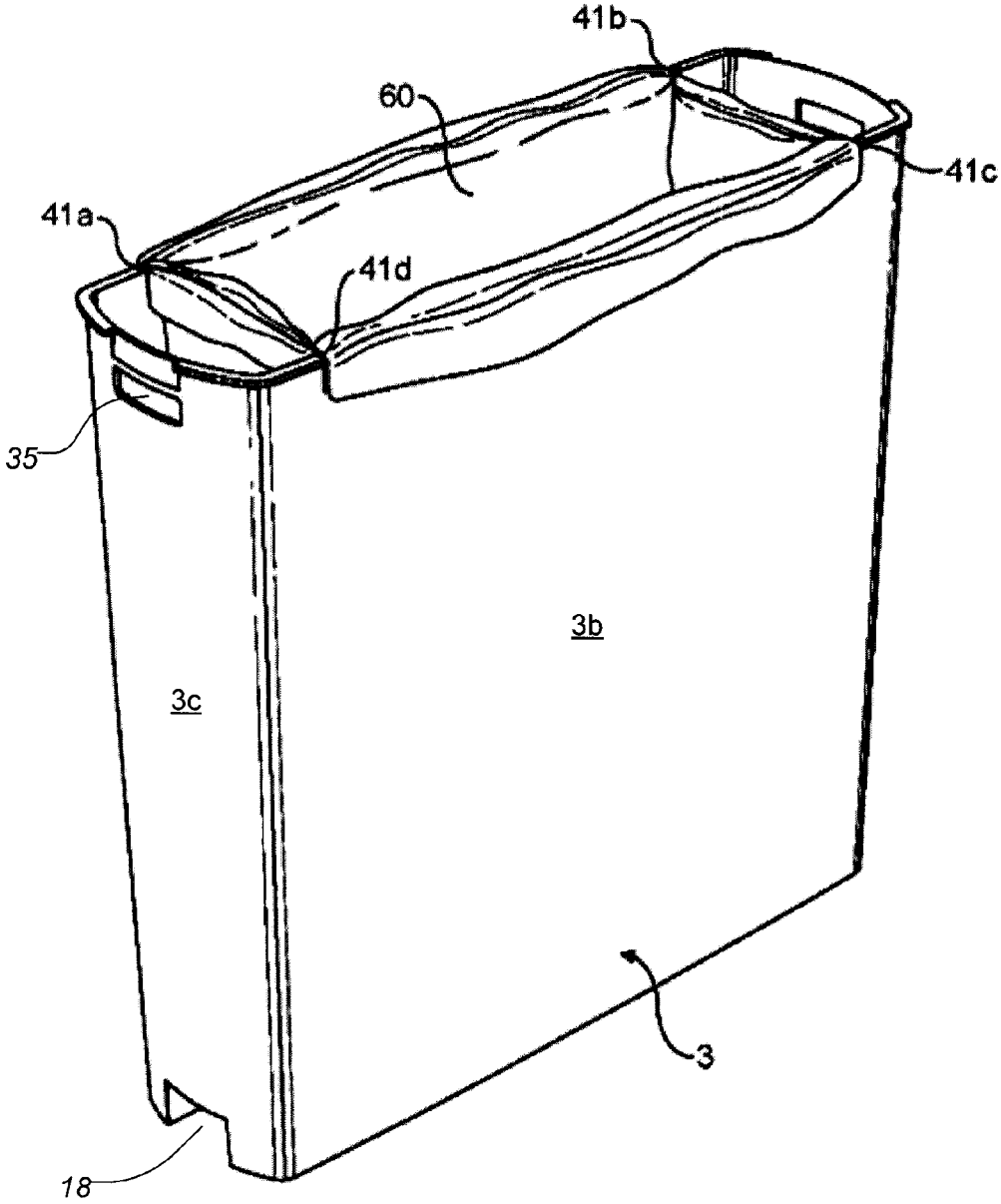
FIG. 11 shows a refuse bag located in the container of the bin according to the present invention.

As shown in FIG. 11, a refuse bag 60 is shown located in the container 3 of the pedal bin 1 according to the present invention. The refuse bag 60 is secured in position by locating portions around the upper edge thereof in the slots 41*a*, 41*b*, 41*c*, 41*d* provided in the upper edge of the container. The slots 41*a*, 41*b*, 41*c*, 41*d* are preferably tapered such that they are widest at the upper edge of the container 3. This tapered arrangement advantageously helps to trap the refuse bag 60 in position.

The provision of the slots 41*a*, 41*b*, 41*c*, 41*d* is particularly desirable as it allows a range of different sizes of refuse bags 60 to be secured in position in the container 3. Although the refuse bag 60 shown in FIG. 11 is secured in position in each of the slots 41*a*, 41*b*, 41*c*, 41*d*, it will be appreciated that a larger bag may be accommodated, for example by locating the bag 60 in the slots 41*b* and 41*d* closest to the actuating member 17 and locating the front of the sack or bag 60 over the front of the container 3. This arrangement may be reversed by locating the front of the bag or sack 60 in the slots 41*a* and 41*d* furthest from the actuating member 17 and providing the rear of the bag over the flange at the back of the container 3. Of course, larger refuse bags or sacks 60 may be located over the front and rear of the container 3 without relying on any of the slots 41*a*, 41*b*, 41*c*, 41*d*. Thus, the provision of the slots 41*a*, 41*b*, 41*c*, 41*d* in the top edge of the container 3 allow a range of refuse bags or sacks 60 to be accommodated.

Although the embodiment described herein relates to a pedal bin 1, it will be appreciated that the reversibility of the top cover 7 may also be desirable in bins which are opened by hand or which are automatically operated. For example, the container 3 described herein may be used without the pedal actuating mechanism (in a hand operated or automatic configuration) and the reversibility of the top cover 7 would allow the bin to be configured in left and right handed versions with the second channel 19 hidden from view at the rear of the bin in use.

In an automatic version of the bin 1, an actuation unit (not shown) is mounted in the top cover 7 along with a power supply, such as a battery pack. The actuation unit comprises a motor which drives a gear wheel to open the flap 9. An overload sensor in the actuation unit detects when the flap 9 has contacted a stop member and sends a signal to stop the motor. The flap 9 may subsequently return to its closed position under gravity. The actuation unit may be activated, for example, by a push button or an infra-red sensor provided in the top cover 7.

In a hand-operated variant of the bin 1, the pedal mechanism may again be omitted and the flap 9 opened simply by lifting the finger grip 29 shown in FIG. 10.

It will be appreciated that various changes and modifications may be made to the pedal bin 1 described herein without departing from the scope of the invention.

Although the embodiment described here is generally rectangular in shape, it will be appreciated that the container 3 may have any cross-sectional shape, provided that it has the requisite symmetry to allow the top cover 7 to be reversed. For example, container 3 may be circular, rectangular, elliptical, oval or square in horizontal cross-section.

Moreover, although the embodiment described herein only facilitates rotation of the top cover 7 through 180 degrees, it will be appreciated that this could be modified to allow the cover 7 to be rotated through any desired angular rotation. For example, the cover 7 could be rotated through 90 degrees between the first and second positions in which it is to be used. Indeed, the cover 7 may be adapted to allow it to be located in more than simply first and second positions. It may, for example, be desirable to allow the orientation of the cover 7 to be varied to allow the flap 9 to open to either of the first and second sides 3*b*, 3*d* of the container 3 and also towards the front side 3*a* of the container 3. To facilitate this functionality, it may be necessary to modify the actuating member 17, for example so that it forms a ring around the interior of the container 3.

Although the container 3 illustrated herein is provided with 2 slots 41*a*, 41*b* in the front wall 3*a* and two slots 41*c*, 41*d* in the back wall 3*b*, it will be appreciated that one slot may be provided in each side wall, or alternatively more than two slots may be formed. The provision of more slots in the first and second side walls 3*c*, 3*d*, would allow a greater range of refuse bags 60 to be accommodated in the container 3. It is generally preferred that the slots in opposing side walls are aligned to allow the refuse bags more readily to be located in the container 3. Furthermore, although the slots 41*a*, 41*b*, 41*c*, 41*d* are shown extending substantially vertically downwardly, it will be appreciated that the slots in each side wall may be angularly offset relative to the vertical. For example, two slots in a side wall may be inclined towards each other effectively forming a V-shape. Inclining the slots towards each other may further assist in retaining the refuse bag 60 in position.

The invention claimed is:

1. A pedal bin comprising:

a container comprising a front wall, a first sidewall and a second sidewall, the first and second sidewalls being opposite to each other and wider than the front wall;

a foot pedal located on the front wall of the container; and a pivotally mounted flap, the flap being locatable in a first position to facilitate opening of the flap in a first direction to the first sidewall of the container, and being locatable in a second position to facilitate opening thereof in a second direction to the second sidewall of the container, wherein the foot pedal is operable to open said flap when said flap is located in said first and in said second positions.

2. The pedal bin as claimed in claim 1, wherein said first direction is opposite to said second direction.

3. The pedal bin as claimed in claim 1, wherein the foot pedal is coupled to an actuating member for opening the flap.

4. The pedal bin as claimed in claim 3, wherein the actuating member is located mid-way between the first and second sidewall s.

5. A pedal bin 6, comprising:

a container;

a pedal; and a pivotally mounted flap, the flap being locatable in a first position to facilitate opening of the flap in a first direction relative to the container and being locatable in a second position to facilitate opening thereof in a second direction relative to the container, wherein the pedal is operable to open the flap when the flap is located in the first position and in the second position, wherein the first direction is to a first side of the pedal bin, and the second direction is to a second side of the pedal bin, wherein the pedal is provided on a third side of the pedal bin, wherein the pedal is coupled to an actuating member for opening the flap, and wherein the actuating member is pivotally mounted.

6. The pedal bin as claimed in claim 3, wherein the flap is provided with first and second members for cooperating with said actuating member, the first member being cooperable with the actuating member when the flap is located in said first position, and the second member being cooperable with the actuating member when the flap is located in said second position.

7. The pedal bin as claimed in claim 6, wherein the first and second members are integrally formed with the flap.

8. The pedal bin as claimed in claim 6, wherein said first and second members are arcuate in profile.

9. The pedal bin as claimed in claim 1, wherein the flap is provided with a member for hiding the contents of the bin from view when the flap is in an open position.

10. The pedal bin as claimed in claim 1, wherein the flap further comprises first and second end-wall members.

11. A pedal bin, comprising:

a container;

a pedal; and a pivotally mounted flap, the flap being locatable in a first position to facilitate opening of the flap in a first direction relative to the container and being locatable in a second position to facilitate opening thereof in a second direction relative to the container, wherein the pedal is operable to open the flap when the flap is located in the first position and in the second position, wherein the flap is provided with a member for hiding the contents of the bin from view when the flap is in an open position, and wherein a removable element is provided at least partially to cover an underside of the flap.

12. The pedal bin as claimed in claim 11, wherein said removable element at least partially covers said member for hiding the contents of the bin from view when the flap is in an open position.

13. The pedal bin as claimed in claim 1, wherein the bin is a sanitary hygiene bin.

14. The pedal bin as claimed in claim 1, wherein the bin has a cover, the flap is pivotally mounted on the cover and means for opening the flap is mounted in the cover, the cover being locatable in a first position to facilitate opening of the flap in the first direction and in a second position to facilitate opening of the flap in the second direction.

15. A pedal bin, comprising:

a container;

a pedal; and a pivotally mounted flap, the flap being locatable in a first position to facilitate opening of the flap in a first direction relative to the container and being locatable in a second position to facilitate opening thereof in a second direction relative to the container, wherein the pedal is operable to open the flap when the flap is located in the first position and in the second position, and wherein the flap comprises a member for hiding the interior of the bin from view when the flap is in an open position, the flap and the member for hiding having means for removably mounting a protective element thereon.

16. The pedal bin as claimed in claim 15, wherein the flap comprises a first member, a second member, a first end-wall and a second end-wall, the first and second members having a common edge and being angularly offset relative to each other, the first end-wall being joined to the first and second members at a first end thereof and the second end-wall being joined to the first and second members at a second end thereof.

17. The pedal bin as claimed in claim 16, wherein the flap is molded from a plastics material.

18. The pedal bin as claimed in claim 15, wherein the protective element is transparent.

19. The pedal bin as claimed in claim 16, wherein the protective element comprises a convex portion to allow the protective element to be removed.

* * * * *